US008479974B2

(12) United States Patent
Seo

(10) Patent No.: US 8,479,974 B2
(45) Date of Patent: Jul. 9, 2013

(54) PAPER CUP WITH HEAT INSULATING MATERIAL ATTACHED

(76) Inventor: Mi Soo Seo, Seoul (KR)

( * ) Notice: Subject to any disclaimer, the term of this patent is extended or adjusted under 35 U.S.C. 154(b) by 0 days.

(21) Appl. No.: 13/313,410

(22) Filed: Dec. 7, 2011

(65) Prior Publication Data

US 2012/0145776 A1 Jun. 14, 2012

Related U.S. Application Data

(63) Continuation-in-part of application No. 12/938,199, filed on Nov. 2, 2010, now abandoned, which is a continuation of application No. PCT/KR2010/000199, filed on Jan. 13, 2010.

(30) Foreign Application Priority Data

Jan. 30, 2009 (KR) ..... 20-2009-0001022 U

(51) Int. Cl.
*B65D 3/22* (2006.01)

(52) U.S. Cl.
USPC ..... 229/403; 220/592.17; 220/592.25

(58) Field of Classification Search
USPC ..... 220/592.16, 592.17, 592.2, 592.25, 220/592.26; 229/402
See application file for complete search history.

(56) References Cited

U.S. PATENT DOCUMENTS

| | | | |
|---|---|---|---|
| 3,049,277 | A | 8/1962 | Shappell |
| 3,126,139 | A | 3/1964 | Schechter |
| 5,469,983 | A | 11/1995 | Yawata |
| 5,525,383 | A | 6/1996 | Witkowski |
| 5,669,553 | A | 9/1997 | Smith |
| 5,794,843 | A | 8/1998 | Sanchez |
| 6,053,352 | A | 4/2000 | Cai |
| 6,116,503 | A | 9/2000 | Varano |
| 6,182,855 | B1 | 2/2001 | Alpert |

(Continued)

FOREIGN PATENT DOCUMENTS

| | | | |
|---|---|---|---|
| JP | 2000-043954 | A | 2/2000 |
| JP | 2005-263275 | A | 9/2005 |
| KR | 20-0314787 | B1 | 5/2003 |
| KR | 20070006919 | A | 1/2007 |

OTHER PUBLICATIONS

USPTO NFOA mailed Jan. 3, 2011 in connection with U.S. Appl. No. 12/938,199.
USPTO FOA mailed Apr. 14, 2011 in connection with U.S. Appl. No. 12/938,199.

(Continued)

*Primary Examiner* — Gary Elkins
(74) *Attorney, Agent, or Firm* — Ladas & Parry LLP

(57) ABSTRACT

A paper cup that contains a beverage and is held by a user with a hand, the paper cup includes: a cup main body formed as a cylinder with an open upper portion, and containing the beverage from the open upper portion; and a heat insulating material disposed on an outer wall of the cup main body so as to reduce a thermal conductivity between the beverage contained in the paper cup and the hand of the user holding the paper cup, and the heat insulating material is partially disposed on an outer wall of the cup main body along with a circumferential direction of the cup main body, and attached to the cup main body so as not to separate from the cup main body. Thus, since the heat insulating material is attached on the outer wall of the cup main body, the heat insulating material is not separable from the cup main body, and the user may conveniently hold the paper cup containing a hot or cold beverage.

2 Claims, 4 Drawing Sheets

U.S. PATENT DOCUMENTS

| | | | | |
|---|---|---|---|---|
| 6,250,545 | B1 | 6/2001 | Mazzarolo et al. | |
| 6,739,470 | B2 | 5/2004 | Yawata | |
| 2004/0251262 | A1 | 12/2004 | Hechmati | |
| 2007/0284426 | A1 | 12/2007 | Lo | |
| 2008/0023538 | A1 | 1/2008 | Robertson et al. | |
| 2008/0105693 | A1 | 5/2008 | Hechmati | |
| 2010/0019023 | A1 * | 1/2010 | Silverstein et al. | 229/403 |

OTHER PUBLICATIONS

USPTO NFOA mailed Jun. 21, 2011 in connection with U.S. Appl. No. 12/938,199.

USPTO FOA mailed Sep. 7, 2011 in connection with U.S. Appl. No. 12/938,199.

* cited by examiner

PAPER CUP WITH HEAT INSULATING MATERIAL ATTACHED

CROSS-REFERENCE TO RELATED APPLICATIONS

The present application is a continuation of pending International patent application PCT/KR2010/000199 filed on Jan. 13, 2010, which designates the United States and claims priority from Korean Patent Application No. 20-2009-0001022 filed on Jan. 30, 2009. The content of all prior applications is incorporated herein by reference.

FIELD OF THE INVENTION

The present invention relates to a paper cup, and more particularly, to a paper cup including a heat insulating material that is not separable from a main body of the paper cup so that a user may hold the paper cup conveniently even when a hot or cold beverage is in the paper cup.

BACKGROUND OF THE INVENTION

For containing beverages such as coffee or juice, paper cups are mainly used in vending machines or coffee shops. FIG. 1 shows an example of a conventional paper cup 1. The conventional paper cup 1 includes a cup main body 2 formed as a cylinder for containing the beverage, and a curled rim 3 formed on an upper end portion of the cup main body 2 for protecting lips of a user and improving configuration maintenance of the cup main body 2.

However, the conventional paper cup 1 is generally formed of thin paper, and thus, when hot coffee or cold juice is in the conventional paper cup 1, the user may experience difficulty in holding the conventional paper cup 1 due to heat or cold transferred to the hand of the user.

Therefore, coffee shops selling hot coffees in the paper cups 1 mainly use a holder 4 that is formed as a loop band fabricated using corrugated fiber board, so that the conventional paper cup 1 containing hot coffee is inserted into the holder 4.

However, as shown in FIG. 1, the holder 4 is inserted from a lower portion of the conventional paper cup 1, and thus, when the user puts the conventional paper cup 1 on a table or in a cup holder of a vehicle, the holder 4 is likely to separate from the conventional paper cup 1 and fall down on the table or the cup holder, for example. Therefore, when the user wants to hold the paper cup 1 again, the user must inconveniently insert the holder 4 on the table or the cup holder on the paper cup 1 again to hold the conventional paper cup 1.

SUMMARY OF THE INVENTION

The present invention provides a paper cup having an improved structure in which a heat insulating material is not separated from a cup main body of the paper cup so that a user may conveniently hold the paper cup in which a hot or cold beverage is contained.

According to an aspect of the present invention, there is provided.

According to another aspect of the present invention, there is provided.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

HEREINAfter, embodiments of the present invention will be described in detail with reference to accompanying drawings.

Figure 1:
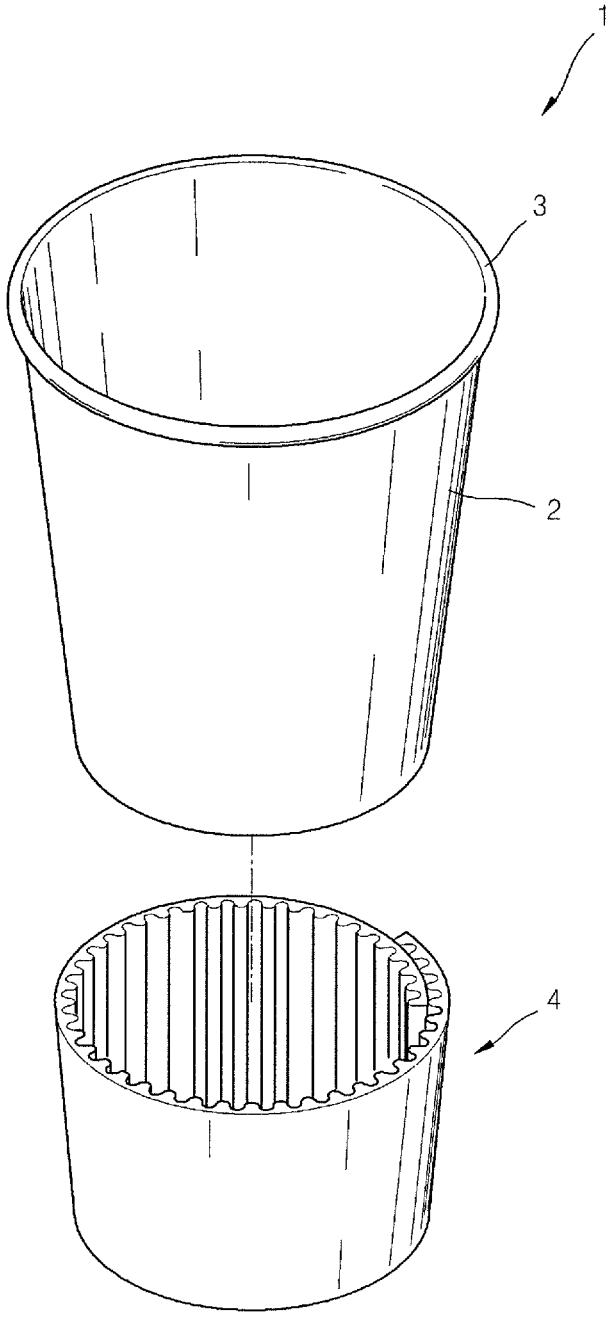
FIG. 1 (PRIOR ART)
FIG. 1 is a perspective view of a conventional paper cup.
Figure 2:
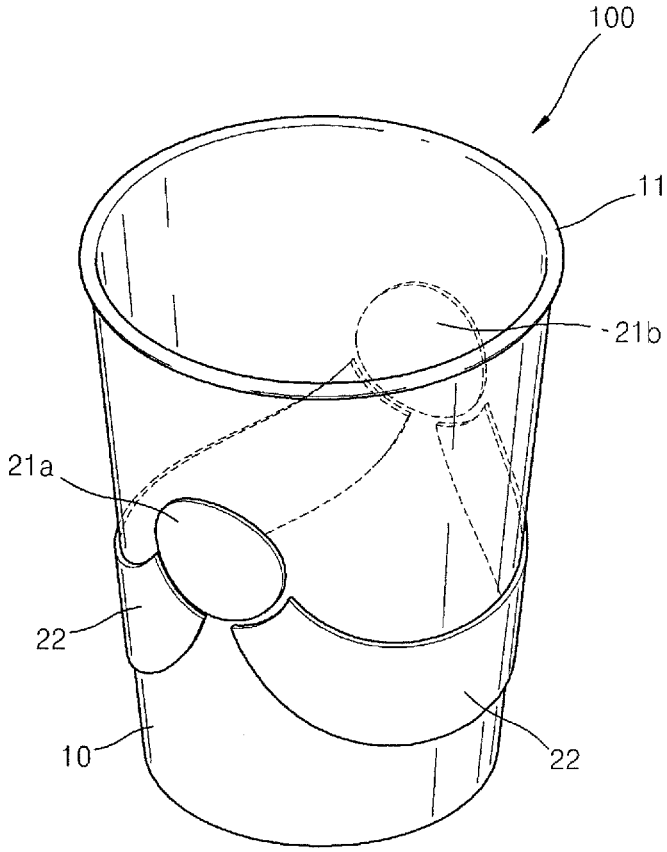
FIG. 2 is a perspective view of a paper cup according to an embodiment of the present invention.
Figure 3:
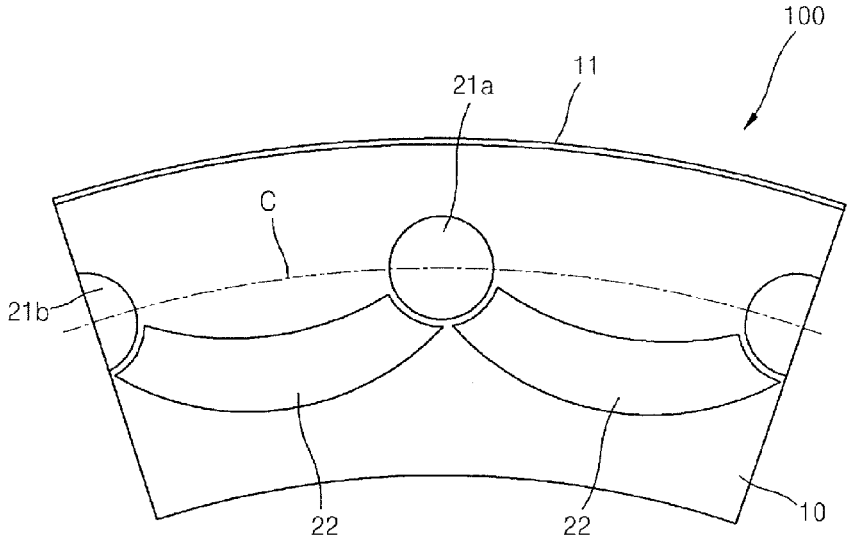
FIG. 3 is a development view of the paper cup shown in FIG. 2.

FIG. 2 is a perspective view of a paper cup 100 according to an embodiment of the present invention, and FIG. 3 is a cross-sectional view of the paper cup 100 taken along line III-III.

Referring to FIGS. 2 and 3, the paper cup 100 according to the present embodiment contains beverages, for example, and is able to be held by a user, and the paper cup 100 includes a cup main body 10 and a heat insulating material 20.

The cup main body 10 is a cylindrical member having an open upper portion for receiving beverages from the open upper portion.

A curled rim 11 is formed at an upper end portion of the cup main body 10 so as to protect the lips of a user and improve the configuration maintenance of the cup main body 10. The curled rim 11 is formed by rolling the upper end of the cup main body 10 out.

The heat insulating material 20 is a member for reducing thermal conductivity between the beverage contained in the paper cup 100 and the hand of the user holding the paper cup 100, and may be, for example, non-woven fabric, corrugated fiber board, foamed synthetic resin, cardboard, or bubble wrap with a plurality of bubble cells. In the present embodiment, the heat insulating material 20 is a transparent thin film of foamed synthetic resin to have a thickness from 0.5 mm to 1.0 mm.

The foamed synthetic resin may be at least one of resins such as polystyrene, polyethylene, and polypropylene, and in the present embodiment, the polyethylene is used.

The foamed synthetic resin used as the heat insulating material 20 is transparent so that characters or figures displayed on an outer wall of the cup main body 20 beneath the heat insulating material 20 may be recognized by the user through the heat insulating material 20.

The heat insulating material 20 is partially attached to the outer wall of the cup main body 10 along a circumferential direction of the cup main body 10 so as not to separate from the cup main body 10. A well-known adhesive having certain degrees of cold-tolerance and thermal-resistance is applied between the heat insulating material 20 and the outer wall of the cup main body 10 so as to attach the heat insulating material 20 to the cup main body 10.

The heat insulating material 20 of the paper cup 100 includes 4 elements that are separated from each other, that is, a first finger contact portion 21*a*, to which some fingers of the hand of the user holding the paper cup 100 contacts, and a second finger contact portion 21*b*, to which the other fingers of the hand of the user holding the paper cup 100 contacts, that is disposed on an opposite side to the first finger contact portion 21*a*, and a couple of palm contact portions 22 that are disposed on an opposite side to each other.

Each of the couple of palm contact portions 22 is disposed between the pair of the finger contact portions 21*a* and 21*b* to be located at a lower level than the line C connecting the centers of the pair of finger contact portions 21*a* and 21*b* so that palm of a person holding the paper cup may naturally contact the palm contact portions 22. In addition, the palm contact portions 22 are formed as curves that are curved downward so as to correspond to a hand of the person holding the paper cup.

When the paper cup 100 having the above-described structure is used, heat or cold of the beverage contained in the paper cup 100 is rarely transferred to the hand of the user holding the paper cup 100, even if the hot or cold beverage is in the paper cup 100. Thus, the user may hold the paper cup 100 continuously without any inconvenience from the hot or cold beverage.

In addition, since the heat insulating material 20 is attached to the outer wall of the cup main body 10, the heat insulating material 20 is not separable from the cup main body 10. Therefore, even when the user holds the paper cup 100 again after putting the paper cup 100 on a table for a while, the user may conveniently hold the paper cup 100 since there is no need to attach the heat insulating material 20 again to the paper cup 100, unlike the conventional paper cup 1 used with the holder 4.

According to the paper cup 100 having the above-described structure, since the heat insulating material 20 is partially attached to the outer wall of the cup main body 10 along a circumferential direction of the cup main body 10, unlike a paper cup in which the heat insulating material 20 surrounds the entire outer wall of the cup main body 10, an area of the film of foamed synthetic resin is reduced and manufacturing costs of the paper cup 100 may be reduced.

In addition, the heat insulating material 20 is a thin film having a thickness of about 0.5 mm to about 1.0 mm, and thus, costs of fabricating the heat insulating material 20 may be reduced.

Also, since the heat insulating material is a thin film having a thickness of about 0.5 mm to about 1.0 mm, following advantages may be obtained. That is, the outer diameter of the paper cup 100 remains almost same to the that of the cup main body 10. Thus, when a plurality of paper cups 100 are stacked on in a beverage vending machine, the lowermost paper cup 100 may be smoothly dropped and discharged one by one without being caught by the vending machine.

In addition, since the heat insulating material 20 includes foamed synthetic resin, following advantages may be obtained. That is, the heat insulating material 20 have inside bubbles which make users feel a nice cushion and not drop the paper cup 100 when users are holding the heat insulating material 20. And the manufacturing costs of the heat insulating material 20 is lower than that of the "unfoamed" resin.

Also, since the heat insulating material 20 includes the palm contact portions 22 that are disposed between the pair of finger contact portions 21*a* and 21*b* at a lower level than the line C connecting the centers of the pair of finger contact portions 21*a* and 21*b*, a user of the paper cup may easily distinguish the finger contact portions 21*a* and 21*b* from the palm contact portions 22, and the palm of the user may naturally contact the palm contact portions 22 in a state where fingers of the user contact the pair of the finger contact portions 21*a* and 21*b*.

In addition, since the palm contact portions 22 are formed as curves that are curved downward to correspond to the hand of the person holding the paper cup, such advantages that a heat insulating effect with respect to the palm may be obtained by using a material of small area and fabrication costs of the heat insulating material 20 may be reduced may be obtained.

In addition, since the heat insulating material 20 uses at least one of the resins such as the polystyrene, the polyethylene, and the polypropylene, such an advantage that the heat insulating 20 may be formed to be transparent or semi-transparent more easily may be obtained.

On the other hand, the foamed synthetic resin used as the heat insulating material 20 is transparent enough for the user to recognize character information or figure information displayed on the outer wall of the cup main body 10 beneath the heat insulating material 20. Therefore, trademarks or advertisements of a beverage merchandiser, which are generally displayed on a paper cup, may not be covered by the heat insulating material 20 so that the user recognizes the trademarks or the advertisements.

Figure 4:
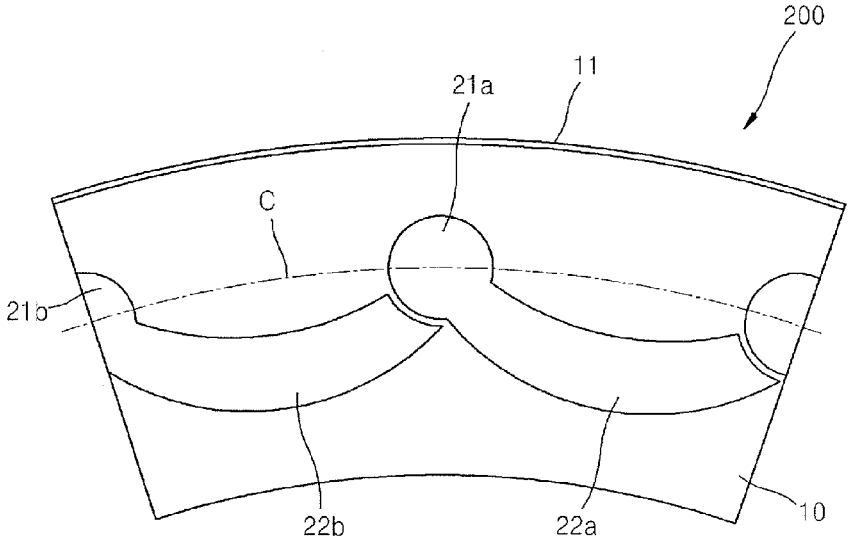
FIG. 4 is a development view of a paper cup according to another embodiment of the present invention.

FIG. 4 illustrates a paper cup 200 according to another embodiment of the present invention. The heat insulating material 20 of the paper cup 200 includes two elements that are separated from each other, that is, a first finger contact portion 21*a* and a first palm contact portion 22*a* connected to the first finger contact portion 21*a*, and a second finger contact portion 21*b* and a second palm contact portion 22*b* connected to the second finger contact portion 21*b*. Since the paper cup 200 has the nearly same structure as that of the paper cup 100 according to the previous embodiment, differences therebetween will be described as follows.

The paper cup 200 has less elements in the heat insulating material 20 than the paper cup 100 of the previous embodiment, and thus, it is easy to attach the heat insulating material 20 onto the cup main body 10.

Figure 5:
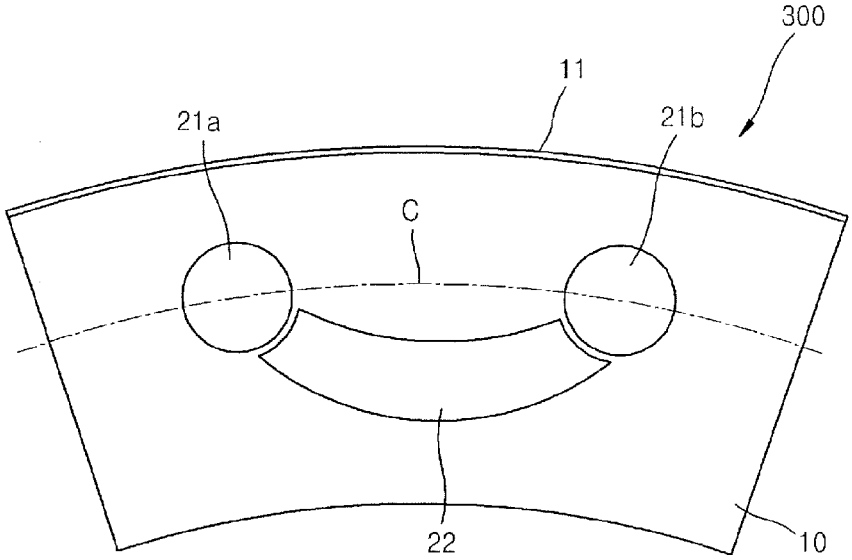
FIG. 5 is a development view of a paper cup according to another embodiment of the present invention.

FIG. 5 illustrates a paper cup 300 according to another embodiment of the present invention. A heat insulating material 20 of the paper cup 300 includes 3 elements that are separated from each other, that is, a couple of finger contact portions 21*a* and 21*b*, and a palm contact portion 22 disposed between the pair of the finger contact portions 21*a* and 21*b* at a lower level than the pair of the finger contact portions 21*a* and 21*b*. Since the paper cup 300 has the nearly same structure as that of the paper cup 100 according to the previous embodiment, differences therebetween will be described as follows.

According to the paper cup 300, the material cost of the heat insulating material may be lower than those of the paper cups 100 and 200.

According to the present invention, since a heat insulating material is attached to an outer wall of a cup main body, a heat insulating material is not separable from the cup main body, and thus, the user may conveniently hold the paper cup even when a hot or cold beverage is in the paper cup.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper cup that contains a beverage and is held by a user with a hand, the paper cup comprising:

a cup main body formed as a cylinder with an open upper portion, and containing the beverage from the open upper portion; and a heat insulating material disposed on an outer wall of the cup main body so as to reduce a thermal conductivity between the beverage contained in the paper cup and the hand of the user holding the paper cup, wherein the heat insulating material is partially disposed on the outer wall of the cup main body along a circumferential direction of the cup main body, and attached to the cup main body so as not to separate from the cup main body, wherein the heat insulating material comprises a couple of finger contact portions, and at least one palm contact portion which is disposed between the couple of finger contact portions, the palm contact portion is disposed at a lower level than the pair of the finger contact portions, and the palm contact portion is formed as a curve that is curved downward so as to correspond to a hand of a person who holds the paper cup, said heat insulating material not extending beyond said finger contact portions and said at least one palm contact portion on the outer wall of the cup.

2. The paper cup of claim 1, wherein the heat insulating material is transparent so that character information or figure information displayed on the outer wall of the cup main body beneath the heat insulating material is recognizable by the user.

* * * * *